US010066180B1

(12) United States Patent
Sugg et al.

(10) Patent No.: US 10,066,180 B1
(45) Date of Patent: Sep. 4, 2018

(54) USE OF HIGH TEMPERATURE OILS TO ENHANCE MECHANICAL DEVICE OPERATION/RELIABILITY

(71) Applicants: Edward A. Sugg, South Riding, VA (US); David W. Sugg, Ashburn, VA (US)

(72) Inventors: Edward A. Sugg, South Riding, VA (US); David W. Sugg, Ashburn, VA (US)

(73) Assignees: Edward A. Sugg, South Riding, VA (US); David W. Sugg, Ashburn, VA (US)

( * ) Notice: Subject to any disclaimer, the term of this patent is extended or adjusted under 35 U.S.C. 154(b) by 0 days.

(21) Appl. No.: 14/713,472

(22) Filed: May 15, 2015

Related U.S. Application Data

(60) Provisional application No. 62/000,703, filed on May 20, 2014.

(51) Int. Cl.

| | |
|---|---|
| ***B08B 3/04*** | (2006.01) |
| ***B05B 11/00*** | (2006.01) |
| ***C10M 105/36*** | (2006.01) |
| ***F41A 29/04*** | (2006.01) |

(52) U.S. Cl.
CPC ..... *C10M 105/36* (2013.01); *B05B 11/30* (2013.01); *B08B 3/04* (2013.01); *F41A 29/04* (2013.01); *C10M 2207/401* (2013.01); *C10N 2230/04* (2013.01)

(58) Field of Classification Search
None
See application file for complete search history.

(56) References Cited

U.S. PATENT DOCUMENTS 4,408,960 A * 10/1983 Allen ..... F04F 1/10 417/125
5,888,947 A 3/1999 Lambert et al.
6,063,447 A * 5/2000 Morand ..... C09D 5/08 106/14.13

(Continued)

FOREIGN PATENT DOCUMENTS

EP 0 494 707 A1 7/1992
EP 1464913 * 10/2004 ..... F41A 29/00

(Continued)

OTHER PUBLICATIONS

English Machine Translation provided for JP10095945 [attached to the foreign document in one file].*

(Continued)

*Primary Examiner* — Mikhail Kornakov
*Assistant Examiner* — Pradhuman Parihar
(74) *Attorney, Agent, or Firm* — Arent Fox LLP

(57) ABSTRACT

An oil for removing or preventing fouling on a mechanical component includes at least one vegetable oil having a flash point of 490° F. or above. A method of removing or preventing fouling on a mechanical component of a device, includes applying a vegetable oil or composition of vegetable oils on the mechanical component of the device. The vegetable oil or composition of vegetable oils has a flash point of 490° F. or above and operation of the device deposits carbon or other types of fouling on the mechanical component.

23 Claims, 12 Drawing Sheets

(56) References Cited

U.S. PATENT DOCUMENTS

| | | | | |
|---|---|---|---|---|
| 6,153,571 | A * | 11/2000 | Komocki | C11D 3/2034 510/190 |
| 6,225,271 | B1 * | 5/2001 | Wright, Jr. | C10M 105/00 510/190 |
| 2003/0069146 | A1 | 4/2003 | Garmier | |
| 2004/0029749 | A1 * | 2/2004 | Legros | C10M 169/04 508/487 |
| 2004/0234701 | A1 | 11/2004 | Caton | |
| 2006/0289087 | A1 * | 12/2006 | Lachance | B27M 3/04 144/380 |
| 2010/0292118 | A1 | 11/2010 | Horton | |
| 2011/0190176 | A1 * | 8/2011 | Perduk | C10M 163/00 508/110 |
| 2012/0042900 | A1 * | 2/2012 | Horton | A61K 8/0208 134/6 |

FOREIGN PATENT DOCUMENTS

| | | | | |
|---|---|---|---|---|
| GB | 1 232 322 | A | 5/1971 | |
| JP | 10095945 | * | 4/1998 | C09D 11/06 |
| WO | WO 98/30668 | A1 | 7/1998 | |

OTHER PUBLICATIONS

Sims, Engineering Formulas, vol. 1, p. 131.*
uccs.edu ; Fatty Acid Composition of Fats and Oils.*
Ventura Foods; Safety Data Sheed (SDS) Cottonseed.*
USFA; Commerical Cooking: Cooking Oil Characteristics.*
Extended European Search Report of European Patent Application No. 13764872.1 dated Nov. 2, 2015.

* cited by examiner

USE OF HIGH TEMPERATURE OILS TO ENHANCE MECHANICAL DEVICE OPERATION/RELIABILITY

CLAIM OF PRIORITY UNDER 35 U.S.C. § 119

This Application for Patent claims priority to U.S. Provisional Application No. 61/000,703, titled "Use of High Temperature Oils to Enhance Firearm and Other Mechanical Device Operation/Reliability," filed on May 20, 2014, the entire content of which is incorporated by reference herein.

FIELD

Aspects of the present disclosure relate to vegetable oils, vegetable oil blends, and various uses thereof. More particularly, aspects of the present disclosure relate to vegetable oils and their uses with mechanical components, for example, firearms to enhance performance and/or reliability.

BACKGROUND

It is known in the related art to use cleaners or, less preferably, cleaner/lubricant/protectant (CLP) oils to remove carbon and other fouling from mechanical parts. In particular, in the area of firearm operation, such as AR-15 or M-16 firearms, when a round is fired, the combustion process deposits carbon within the firearm, as shown in FIG. 1. The depositing of carbon leading to fouling is a well known problem in the art, an example of which is shown in FIG. 2. Carbon fouling requires a time-consuming cleaning process that may take up to three days for sufficient removal of carbon to allow proper operation of the firearm. When the carbon fouling becomes too great, the firearm will malfunction or cease operation entirely, which is a problem in battle or defensive situations, for example, and a significant nuisance to civilian shooters.

Currently, various lubricant compositions are known for use on firearms to remove carbon fouling from the firearm. However, known compositions do not satisfactorily remove carbon, especially at temperatures above 160° F. Many existing products "bake on" at temperatures near or above this level, which exacerbates fouling issues and creates stoppages. Ambient temperatures in current combat zones can often reach 120° F. The sun can heat black metal objects another 40° F. or more before the weapon is even fired. Many test results have shown that critical moving parts of the weapon can reach 70° F. or above ambient temperature in even modest firing cadences, which are further magnified in battle conditions. Furthermore, some known compositions are synthetic and harmful when exposed to the human body. For example, several known lubricant compositions include: Mobil 1® 10W-30 sold by Mobil, SLIP2000™ Carbon Killer sold by SPS Marketing, FrogLube® sold by AUDEMOUS INC, Gunzilla® sold by TopDuck Products, LLC, Hoppe's Elite® Gun Cleaner sold by Bushnell Outdoor Products, and Break Free® sold by SAFARILAND. Each of these commercial compositions has significant flaws and/or drawbacks. For example, Mobil 1® 10W-30 synthetic is hydrocarbon based, creates a sludge when contacted with carbon fouling, and is not polar. SLIP2000™ Carbon Killer does not lubricate, strips metal of oils, and damages anodized aluminum and blued steel. Stripping oils from metals in a firearm can cause the firearm to seize. FrogLube® is only functional in a very narrow temperature range. It solidifies at 48° F., and smokes at 150° F. After smoking, it leaves behind a sticky gummy residue. Gunzilla® is harmful or fatal if swallowed, and is a very poor performing cleaner. Hoppe's Elite® does not act as a lubricant and removes oils and contains hazardous diethylene glycol monobutyl ether. Break Free® contains petroleum distillates. Petroleum distillate products contain harmful, carcinogenic components and are treated as hazardous materials both in shipment and disposal.

U.S. Pat. No. 6,534,454 is directed to a biodegradable vegetable oil composition comprising a triglyceride oil, an antioxidant, and other oils. The other oils may be synthetic ester base oil, polyalphaolefin, or unrefined, refined, or re-refined oils. The triglyceride oils are vegetable oils.

U.S. Pat. No. 6,383,992 is directed to biodegradable vegetable oil compositions having at least one triglyceride oil, a pour point depressant, an antioxidant, and other oils. The triglyceride oils are vegetable oils.

U.S. Pat. No. 6,919,302 is directed to the use of an oil composition for temporary treatment of metal surfaces.

Further, current lubricants for mechanical components including firearms lubricants do not take into account extreme heat in fully automatic or suppressed fire. Sustained semi-automatic fire in battle or intense competition can result in extreme heat that will cook or burn off lubricant, resulting in weapon failure. Such failure will result in injury or death in battle. Further, in competition, such failure will result in the loss of matches.

Thus, there remains a need in the art for natural, safe, oil compositions and methods of using the compositions for avoiding and removing carbon fouling in mechanical components, and providing highly heat-resistant lubrication and a fouling resistant environment.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

Aspects of the present disclosure provide, among other things, a vegetable oil or vegetable oil compositions and methods of use thereof to avoid and reduce fouling on mechanical components, lubricate mechanical components, and provide long-term carbon fouling protection.

In one example variation, a vegetable oil or composition of vegetable oils having a flash point of 490° F. or above may be applied to a mechanical component of a device. The vegetable oil or composition of vegetable oils may be used in an environment where the fouling is avoided or removed to improve performance, such as on various parts of firearms, bicycle or motorcycle chains, chain saws, and engines. The vegetable oil or composition of vegetable oils may also be used as a lubricant, such as in fishing equipment.

In an aspect, the vegetable oil or composition of vegetables oils has a flash point of at least 490° F. or more, preferably at least 500° F. In another aspect, the fouling may include carbon fouling or any other types of fouling.

In another variation, a method of removing or preventing fouling on a mechanical component of a device, includes applying a vegetable oil or composition of vegetable oils having a flash point of 490° F. or above on the mechanical component of the device. The fouling may include carbon fouling or any other contaminant fouling. Further, the vegetable oil or composition of vegetable oils may include at least one vegetable oil present in an amount of at least about 25% by volume of a total volume of the oil composition; and operation of the device deposits the contaminant fouling including carbon on the mechanical component.

In an aspect, applying of the method includes one of: spraying, immersing, wiping, rubbing, bushing, or otherwise applying the vegetable oil or composition of vegetable oils on the mechanical component of the device.

In an aspect, the method includes drying the applied vegetable oil or composition of vegetable oils by heating at a temperature between about 100° F. and about 400° F. Further, the method further includes exposing the applied vegetable oil or composition of vegetable oils to ultraviolet light.

In an aspect, the method may further include drying the applied vegetable oil or composition of vegetable oils by heating at a temperature between about 25° F. and about 125° F. The drying of the applied vegetable oil or composition of vegetable oils may include heating combined with any added air movement or wind.

In an aspect, the mechanical component is immersed in the vegetable oil or composition of vegetable oils at a temperature of about 100° F. to about 400° F. for a period between about 10 minutes to about 24 hours. Further, the mechanical component comprises a component of a firearm or a related accessory.

In an aspect, applying a vegetable oil or composition of vegetable oils include applying a pressure of about 1 ATM to about 5 ATM.

In an aspect, the mechanical component of the firearm is selected from the group consisting of: a trigger, a hammer, a disconnector, a trigger pin, a firing pin, a chamber, a bolt, a bolt face, a bolt carrier, a breach face, a camming pin, a piston, an operating rod, a gas tube, a barrel, a slide, a retention rail, an upper receiver, a lower receiver, a magazine follower, a suppressor mount, a compensator, a flash hider, charging handle, freed tray, and a baffle.

In an aspect, a pressurized container comprising the vegetable oil or composition of vegetable oils is provided. A sealed package comprising an absorbent wipe having the vegetable oil or composition of vegetable oils absorbed therein is provided. Further, a container comprising the vegetable oil or composition of vegetable oils is provided and the container includes a pump for releasing the vegetable oil or composition of vegetable oils from the container.

Additional advantages and novel features of various aspects of the present disclosure will be set forth in part in the description that follows, and in part will become more apparent to those skilled in the art upon examination of the following or upon learning by practice thereof.

DETAILED DESCRIPTION

Figure 1:
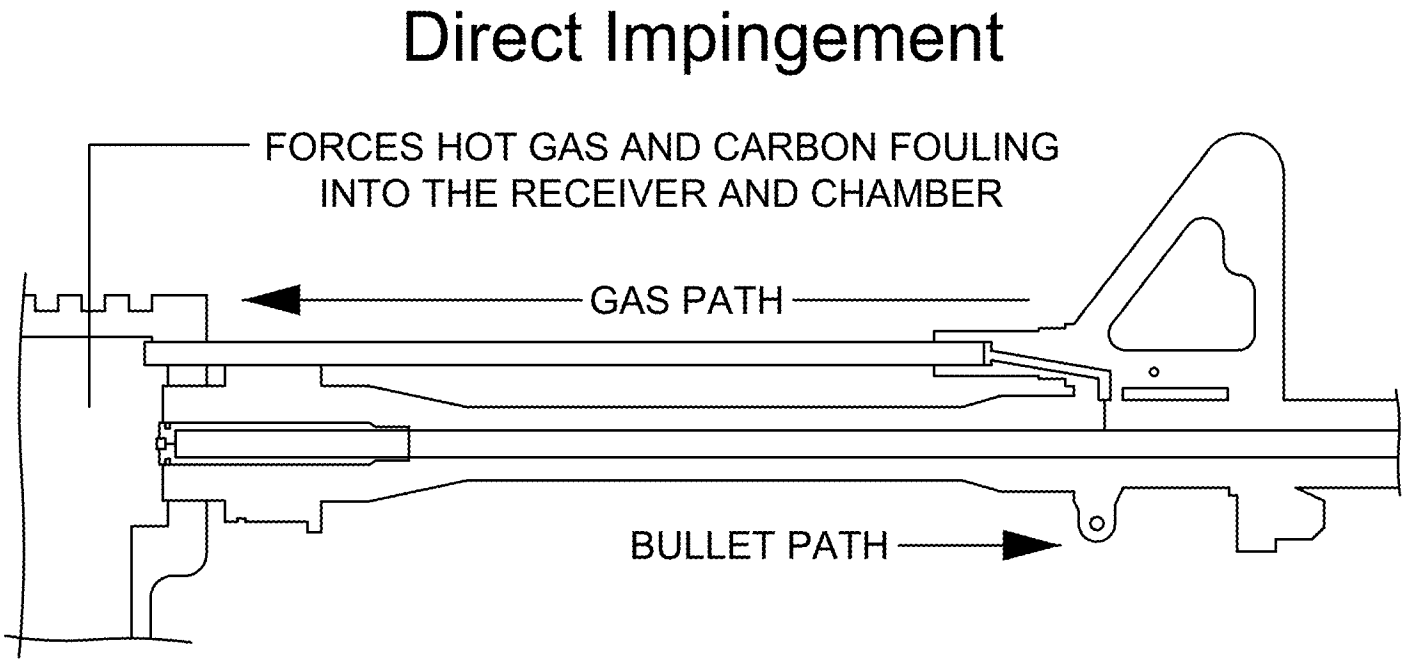
FIG. 1 shows a prior art firearm schematic showing where carbon fouling occurs.
Figure 2:
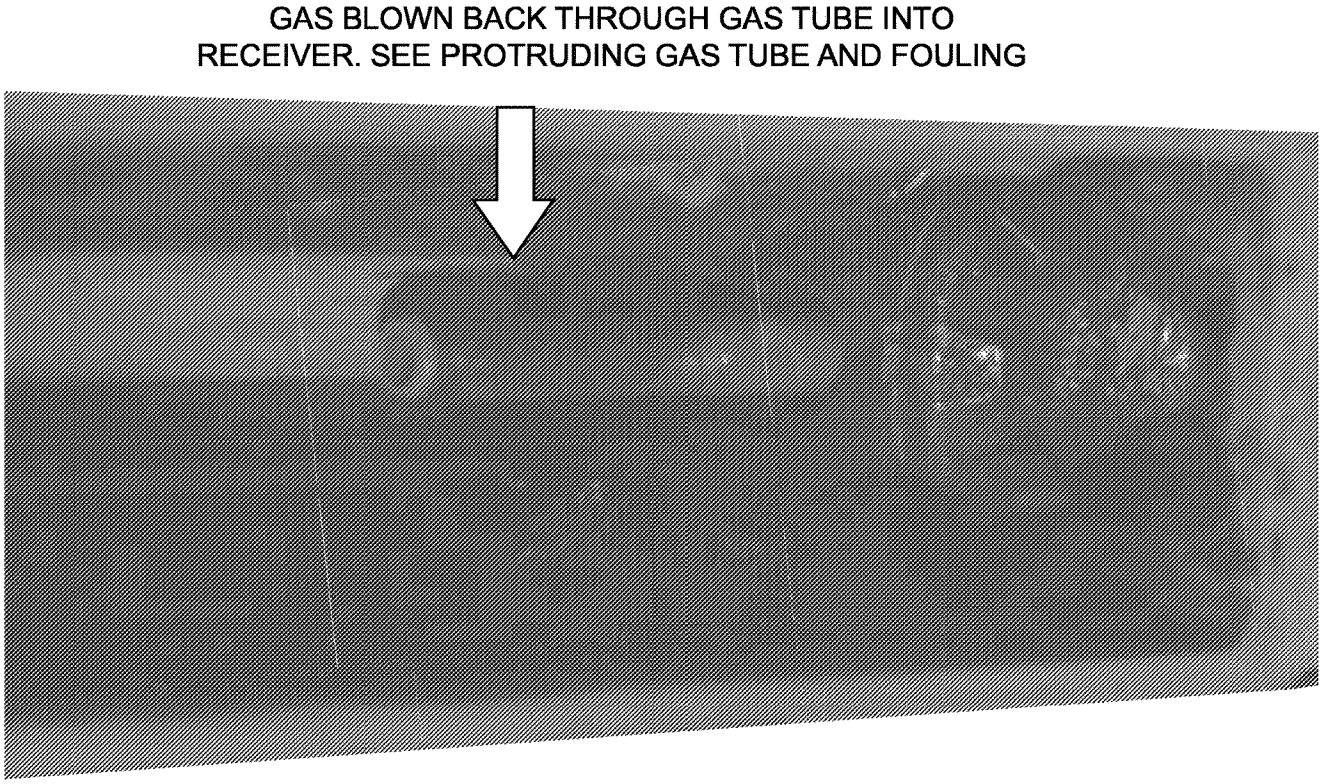
FIG. 2 shows a prior art firearm fouled with carbon.
Figure 3:
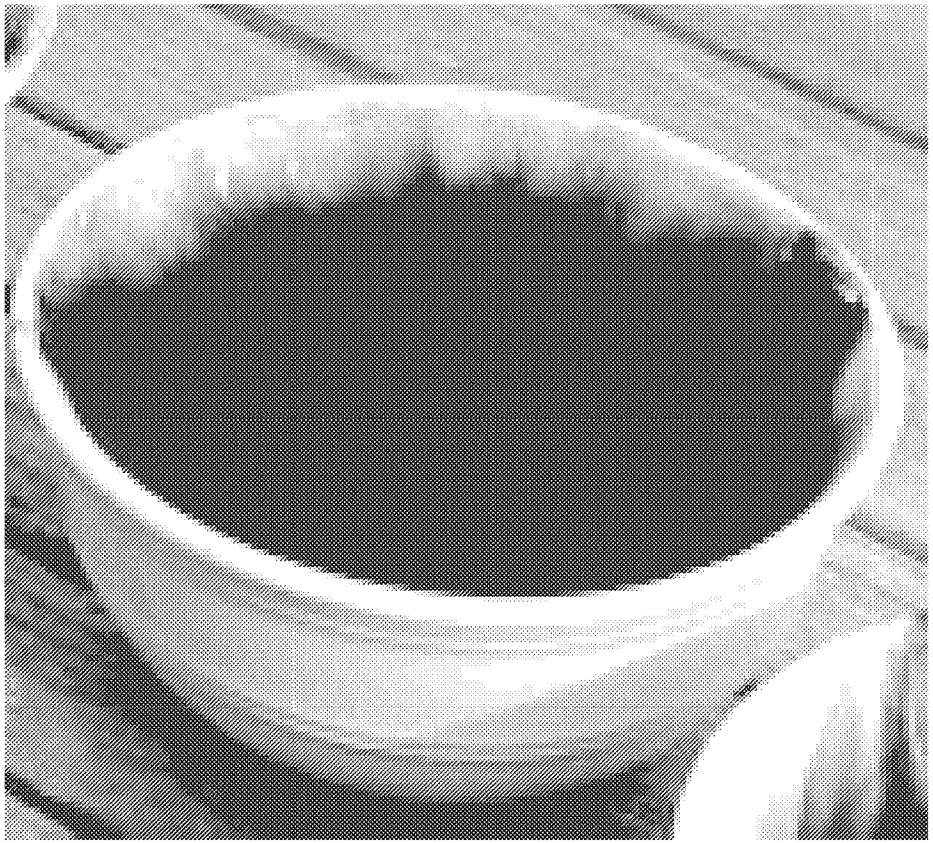
FIG. 3 shows pictures of a fouled bowl before testing.
Figure 4:
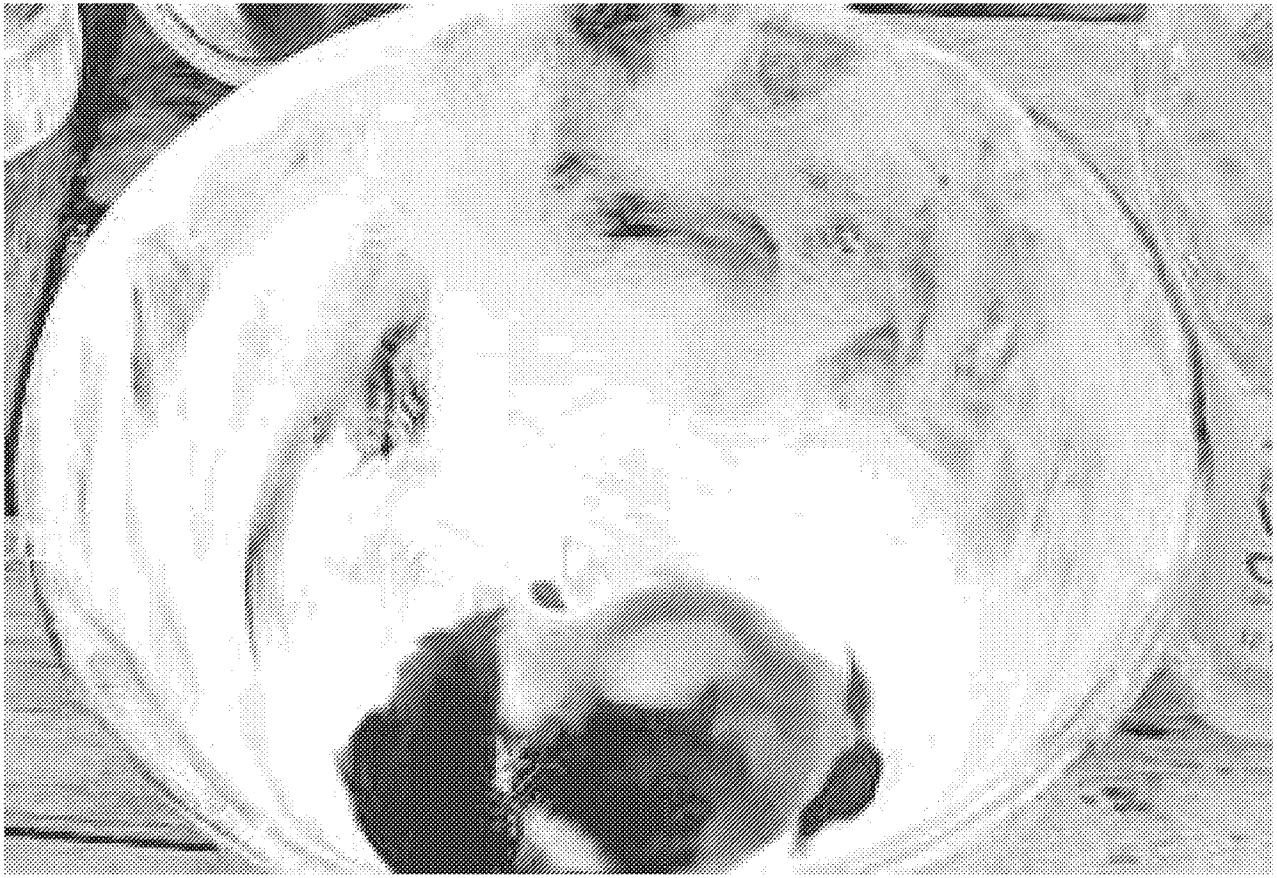
FIGS. 4-12 show pictures of experimental results from foul removal testing, including in conjunction with use of products and methods in accordance with aspects of the present disclosure.
Figure 5:
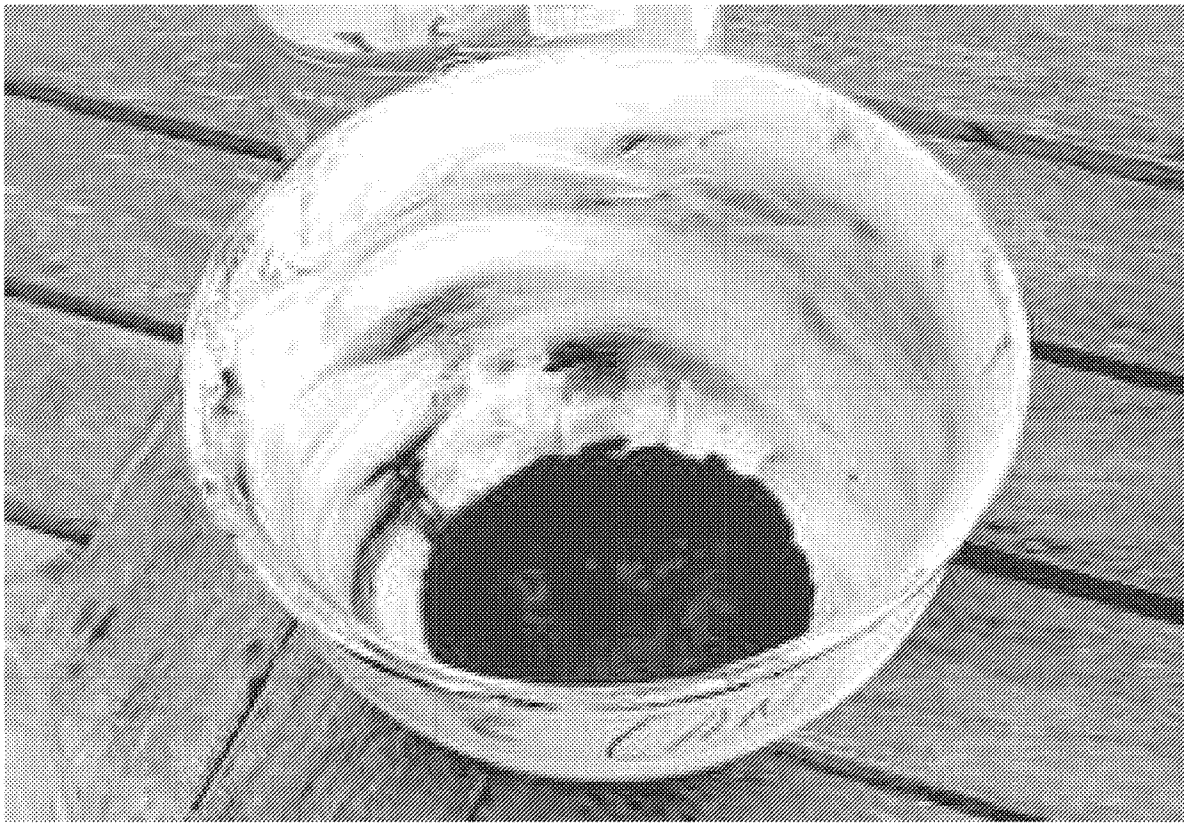
Figure 6:
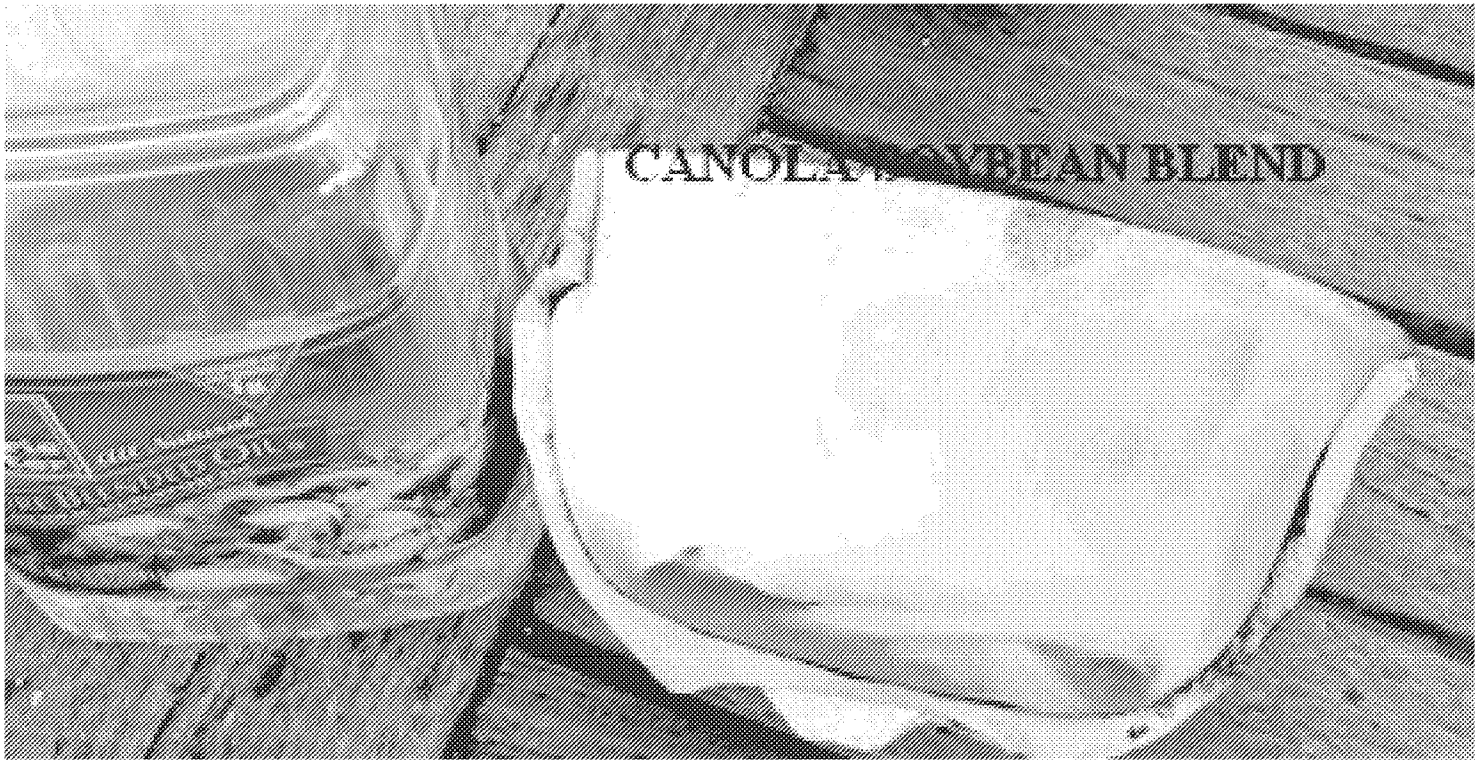
Figure 7:
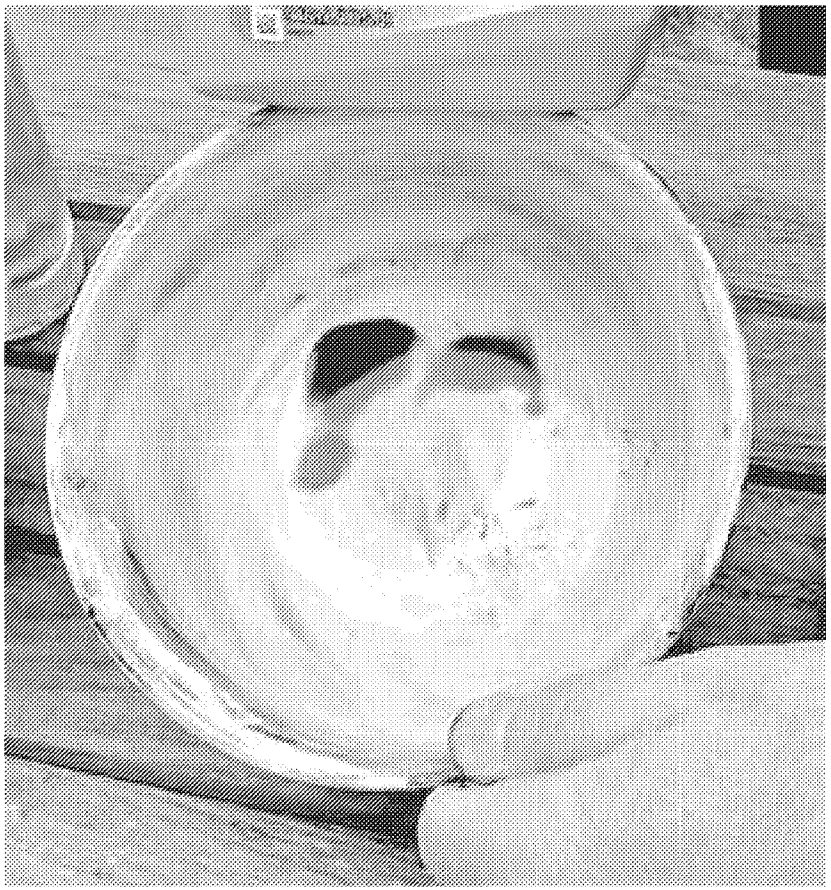
Figure 8:
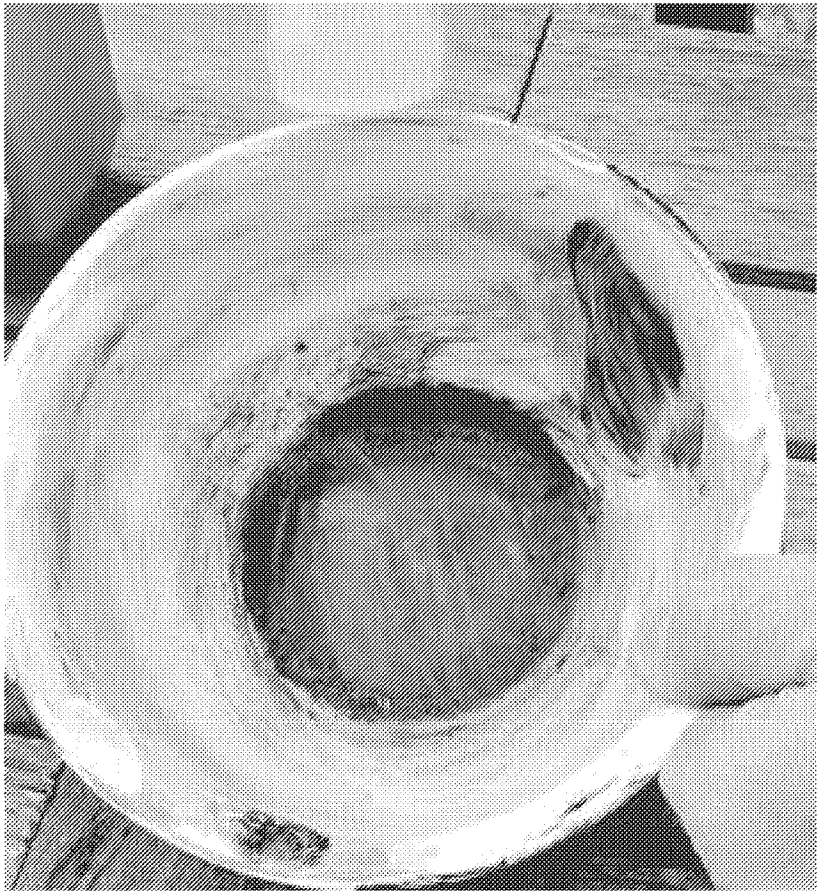
Figure 9:
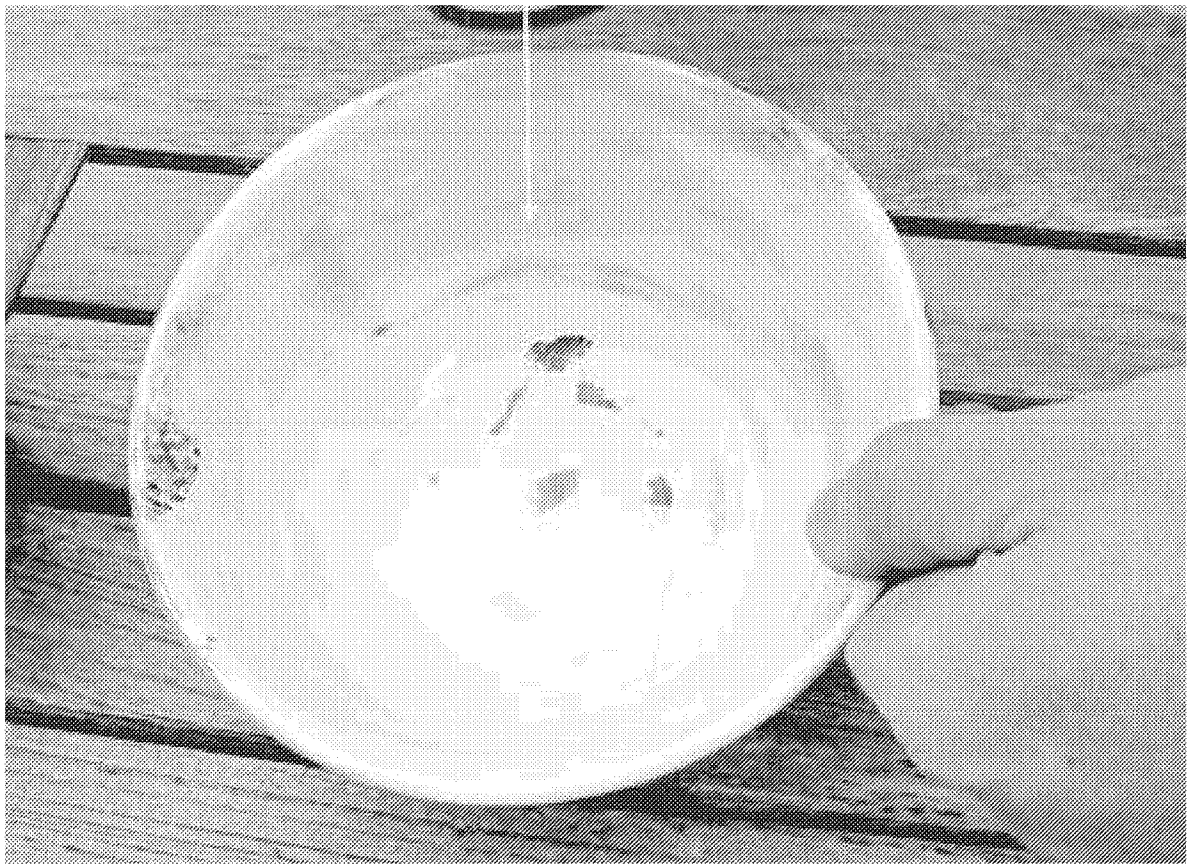
Figure 10:
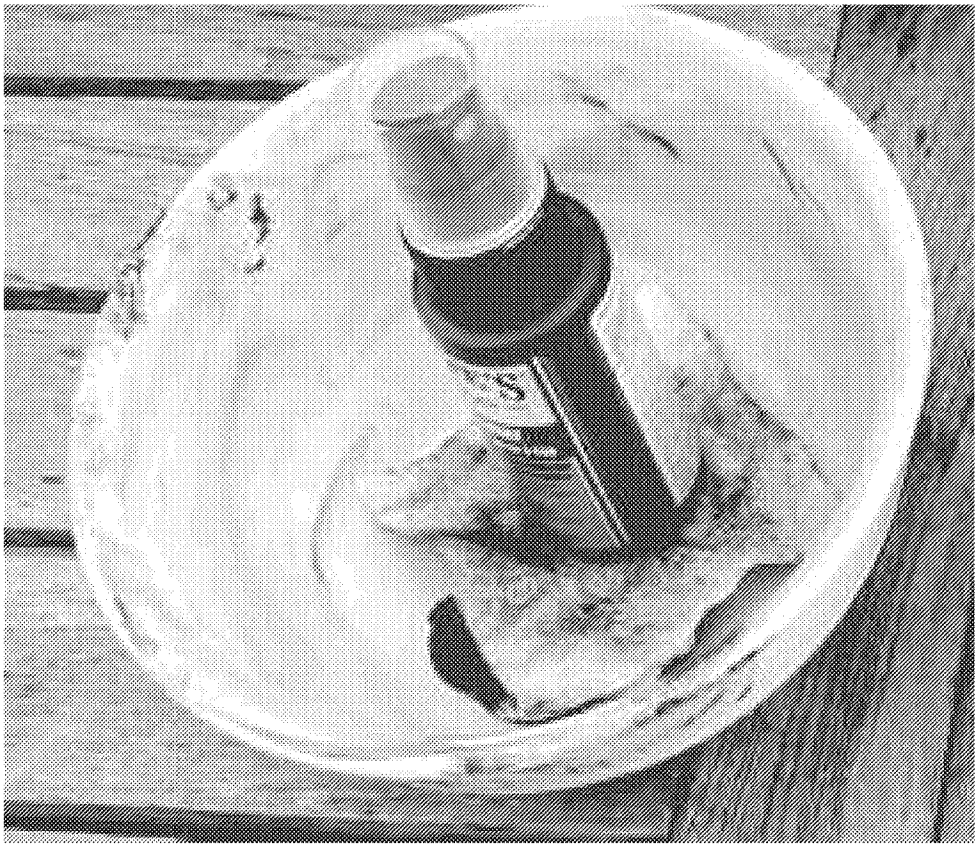
Figure 11:
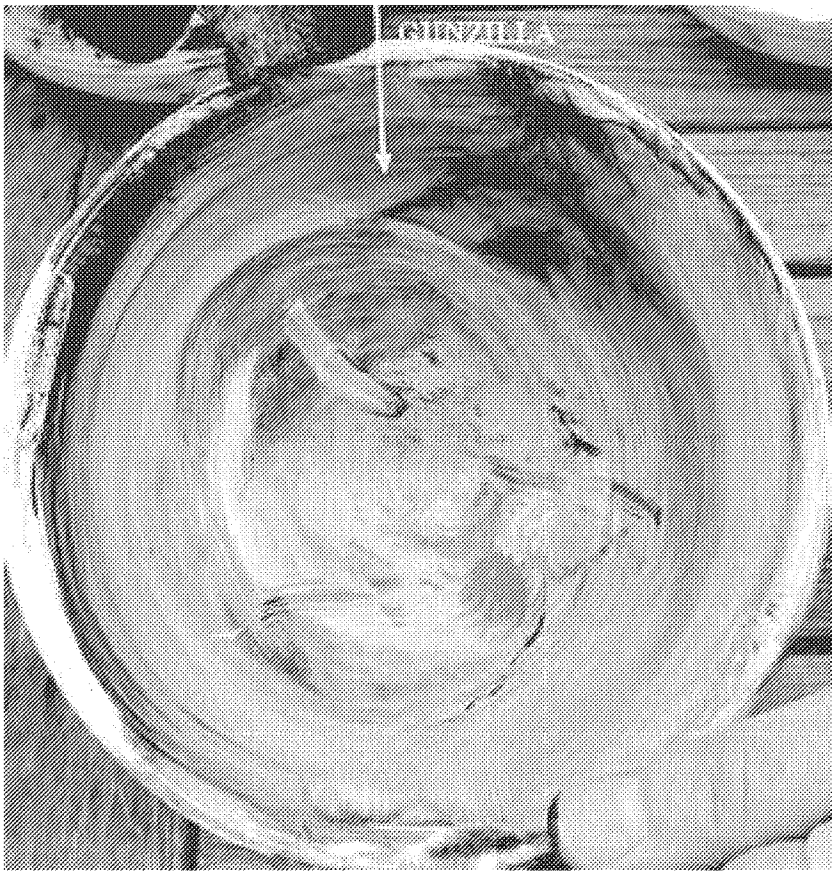
Figure 12:
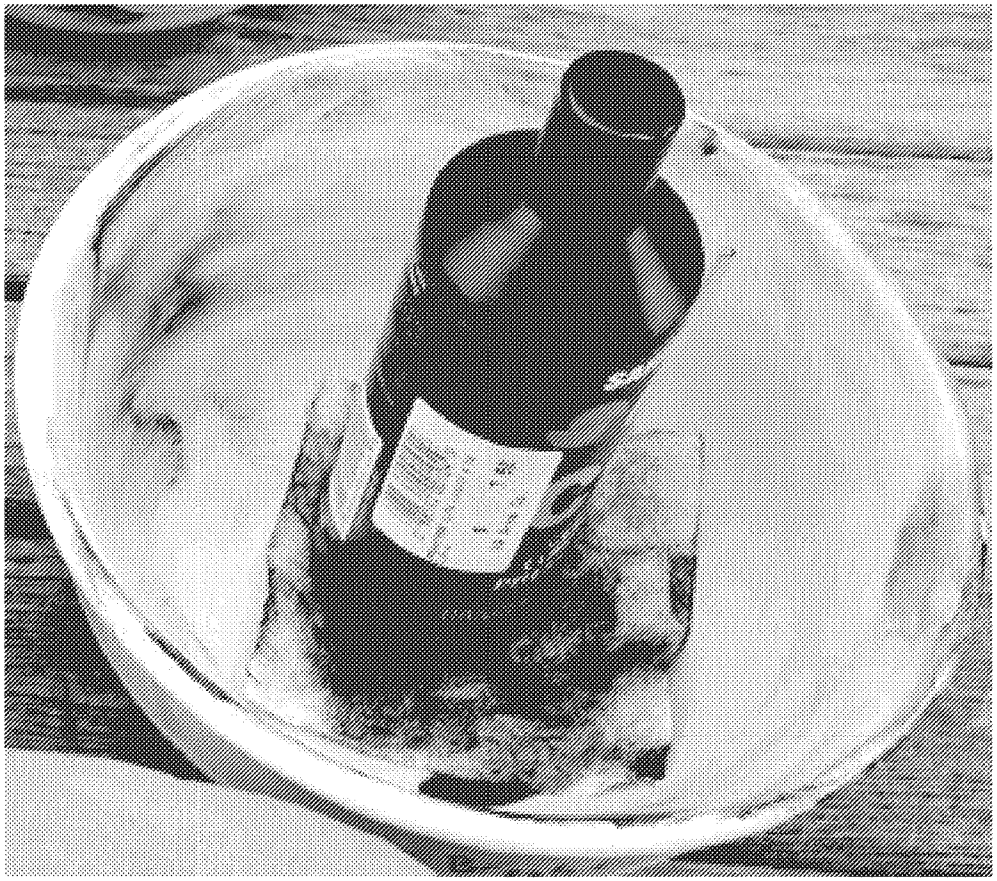

Aspects of the present disclosure include a method of removing or preventing fouling such as carbon fouling on a mechanical component of a device by applying (e.g., depositing) a vegetable oil or composition of vegetable oils on the mechanical component. Aspects of the present disclosure also include components and makeups of various compositions of vegetable oils. As used herein, the term "about" means±10%, more preferably ±5%, still more preferably ±1% of a given value.

The term "vegetable oil or oils," as used herein, means any single natural, non-petroleum, non-synthetic oil derived from a plant, vegetable or fruit or shrub or flower or tree nut, or any combination of natural, non-petroleum, non-synthetic oils derived from a plant, vegetable or fruit or shrub or tree nut. In an aspect of the present disclosure, it has been surprisingly found that pure vegetable oils and various vegetable oil blends or compositions are superior to commercially available products in removing or avoiding fouling including carbon fouling on mechanical components. In addition, the vegetable oil or composition of vegetable oils acts as a lubricant. Example methods may include the application to a mechanical component that is part of device where operation of the device results in carbon being deposited on the mechanical component, including devices that are used in an environment where carbon and/or other fouling should be avoided or removed to improve performance. For example, the vegetable oil and/or the composition of vegetable oils may be applied to portions of firearms, bicycles (for example mountain bikes), motorcycles and engines. The vegetable oil or the composition of vegetable oils may also be used as a lubricant, for example in fishing equipment. These oils also appear to be more resistant to dust or sand buildup than conventional products.

In an aspect of the present disclosure, the vegetable oil or the composition of vegetable oils may be used to form a carbon-resistant and any fouling-resistant film by applying the vegetable oil or the composition of vegetable oils to mechanical components, and allowing the vegetable oil or the composition of vegetable oils to oxidize, such as by exposing the oil vegetable oil or the composition of vegetable oils to heat, air, or ultra-violet (UV) light, which forms a hard dry film on the surface of the mechanical components. This resulting dry film or wet oil layer is resistant to carbon fouling and other types of fouling. In addition, in some variations, the film or wet oil layer may enhance lubrication and/or other properties. In accordance with aspects of the present disclosure, the carbon bonds are weakened and further bonding of the carbon to metal and other parts is significantly reduced. Additionally, the vegetable oil or composition of vegetable oils in this class exhibits profound carbon and heavy metal "solvent" qualities without having environmental or human toxicity issues. The same is true of their lubrication properties without the inherent toxicity issues. In addition to these inherent advantages for removing or preventing fouling (e.g., carbon fouling) on a mechanical component described above with respect to use of vegetable oils and compositions thereof, in accordance with the present disclosure, other advantages may be obtained by adding anti-oxidants to the vegetable oil or composition of vegetable oils to prolong shelf life, and/or adding corrosion inhibitors to the vegetable oil or composition of vegetable oils to better resist rust and other corrosion. Further, in another aspect, pour point depressants may be added to the vegetable oil or composition of vegetable oils for even better low temperature performance. In another aspect, extreme pressure (EP) additives may also be added for additional lubrication performance. It is noted that the selection and blending of different types of additives will be apparent to those skilled in the art.

The mechanical component is preferably a component of a device that, when the device is operated, carbon fouling or other types of fouling are deposited on the mechanical component. This method is discussed in more detail below. Once the vegetable oil or the composition of vegetable oils is applied to the mechanical component, the vegetable oil or composition of vegetable oils has proven to be highly resistant to water and resistant to soap sand other cleaning agents, as compared to known petroleum based or synthetic oils, which tend to wash off when exposed to water spray or rain.

The vegetable oil or composition of vegetable oils may be applied to carbon steel parts, including bare steel, phosphate coated steel, chrome coated steel, ceramic coated steel, and the like, stainless steel parts, titanium parts, aluminum parts, including anodized or other coated aluminum, nickel alloys, plastics, any composites, and any other materials. When used in a firearm, the parts of the firearm, any attachment, or accessories (e.g., suppressors, weapon lights, weapons mounts and feeding device(s), etc.), which may be coated, include the parts that are subject to fouling as a result of gunpowder or other combustion, or having reciprocating or frictional contact surfaces. For example, such parts may include fire control group parts, including triggers, hammers, disconnectors, and trigger pins, firing pins, chambers, bolts, bolt faces, bolt carriers, breach faces, camming pins, pistons, operating/piston rods, gas tubes, barrels, slides and retention rails on pistols, upper and lower receivers, charging handles, feed trays, and magazine followers as well as pistons, operating rods ("op rods") and other parts of firearms or accessories that may become fouled. When used on a bicycle or motorcycle, the vegetable oil or composition of vegetable oils may be applied to chains and gears, such as derailleur gears, for example, and on control mechanisms such as shift and brake cables. When used in an engine, the vegetable oil or composition of vegetable oils may be applied to any of the moving parts of the engine including valves, pistons, and ball bearings, for example. When used in fishing equipment, the vegetable oil or composition of vegetable oils may be applied to reels and gears, for example.

In an aspect of the present disclosure, a single vegetable oil or vegetable oil blend or composition that is suitable for the above uses includes any single oil or blend that sufficiently reduces fouling including carbon fouling or other types of contaminant fouling, or avoids carbon fouling or other contaminant build-ups. In an aspect of the present disclosure, the vegetable oil or composition of vegetable oils that may be used in the above manner may include at least about 25% vegetable oil, more preferably at least about 50% vegetable oil, still more preferably at least about 75%, and most preferably up to 100% or 100% vegetable oil, by volume. Preferably, for some applications, the vegetable oil should have a flash point higher than 490° F., more preferably above 500° F., in order to maintain oil integrity even at very high operating temperatures, which often occurs in firearms. Additionally, vegetable oils that have a high flash point are desirable due to their heat resistance. Highly refined vegetable oils are also useful for some applications.

Higher refined vegetable oils are purer as compared to unrefined vegetable oils. In another aspect of the present disclosure, at least one of or all of the vegetable oils may be high oleic. High oleic oils have a high degree of oleic acid, for example approximately 80% by weight oleic acid or greater, preferably 86% or greater, more preferably 90% or great, and even more preferably 95% or greater. By using the high oleic acid oils that have a high monounsaturated to polyunsaturated fat ratio, oxidation can be reduced. It has been found that the oxidation of the vegetable oils in accordance with aspects of the present disclosure yields a hard, lubricious or slick surface that is resistant to fouling including carbon fouling and other types of fouling, which is discussed below. Generally, a desired ratio of monounsaturated to polyunsaturated fats in accordance with aspects of the present disclosure is at least about 3:1, and for some applications, preferably greater than 3:1. At least one or all of the vegetable oils in the present disclosure may be high oleic. Reducing the polyunsaturated fats also enhances the temperature range (pour point to smoke point range) as well as the storage stability.

Further, in accordance with another aspect of the present disclosure, some variations of vegetable oil may reduce waxes and other contaminants, which ensure improved characteristics at low temperatures and also reduce gumming of vegetable oil in the firearm or other mechanical devices. Improved characteristics may include improved oxidative stability and lower pour point. Accordingly, for some variations of the present disclosure, the vegetable oil or composition of vegetable oils may remain in liquid form at temperatures as low as about −10° F. and as high as about 500° F. The vegetable oil or composition of vegetable oils may have a pour point of about −40° F. to about 25° F., a cloud point of about 5° F. to about 70° F., and flash point of at least 490° F., more preferably at least 500° F. In an aspect of the present disclosure, the vegetable oil or composition of vegetable oils may include one or more of the above properties. As noted earlier, shelf life can be extended with the addition of anti-oxidants, rust and corrosion resistance can be enhanced with the addition of corrosion inhibitors, cold weather performance can be enhanced with the addition of pour point depressants, and lubrication properties can be enhanced with EP (extreme pressure) additives. Those skilled in the art will recognize what additives will best enhance overall performance of the vegetable oil or composition of vegetable oils in accordance of the present disclosure.

Also, in another aspect of the present disclosure, the vegetable oils may have a polar nature, which is not a characteristic found in petroleum-based products. The polarity ensures that the vegetable oil attracts strongly and penetrates deeply into the host metal and adheres better than non-polar oils, a feature that is highly desirable in a mechanical device that is blasted by gases, carbon, high heat, and extreme gravitational forces. The reciprocating bolt carrier on an M-16, for example, accelerates from 0 to over 40 miles per hour in only 20 milliseconds, in a distance of approximately one inch. This feature of vegetable oils in accordance with the aspects of the present disclosure keeps the gun running long after a conventional lubricant has burned off and allowed carbon overload to occur. Because known petroleum-based products do not have this quality, the products do not have the attraction and penetration of the vegetable oil or composition of vegetable oils.

Aspects of the present disclosure further include any vegetable oil or plant based oil, or any combination thereof.

As used herein, the term "distinct" means not the same as another vegetable oil and/or derived from a different plant, vegetable, fruit, shrub, flower, or tree nut. For example, canola oil is distinct from soybean oil.

In an aspect of the present disclosure, a combined volume of the vegetable oils is at least about 25% of a total volume of the oil composition, more preferably at least about 50% of the total volume of the oil composition, still more preferably at least about 75% of the total volume of the oil composition, and most preferably about 100% of the total volume of the oil composition.

In an aspect of the present disclosure, the composition may include, by volume, about 1% to about 80%, and more preferably for some applications about 5% to about 60% of each vegetable oil, and most preferably for some applications about 7% to about 30% of each of these vegetable oils. The composition may comprise these oils, any blends, or additives. As noted above, the composition may include other components such as synthetic oils and other additives that don't substantially interfere with the above-described properties of the overall composition in accordance with an aspect of the present disclosure.

In certain aspects of the present disclosure, the vegetable oil or composition of vegetable oils with a flash point of 500° F. or above may be used as a firearm lubricant or metal fouling protectant, such as carbon/fouling protectant. As shown in Table 1 below, currently there is no firearm lubricant or metal carbon/fouling protectants with flash point of 500° F. or above on the market. Note that the phrase "flash point" is used herein to mean the lowest temperature at which a liquid (or lubricant) generates sufficient vapor to flash or ignite when exposed to a source of ignition such as fire.

TABLE 1

Current Commercial Firearm Lubricants on the Market

| Products | Flash Point |
|---|---|
| Rem Oil (Remington) | 105° F. |
| Boeshield | 120° F. |
| Kroil | 124° F. |
| Ballistol | 126° F. |
| Military Specification (Mil Spec) for current lubricant (CLP) | >175° F. |
| Break Free (ATK) | 201° F. |
| Hoppe's Oil | 378° F. |
| Hoppe's Elite Oil | 374° F. |
| MPro 7 (Hoppe's) | 374° F. |
| Slip 2000 EWL | 410° F. |
| Rand CLP (Rand Brands) | 410° F. |
| Mobil 1 Synthetic 5W30 Oil | 446° F. |
| Brownell's Friction Defense | 450° F. |

As shown above, there is no known product on the market, of which the flash point of the product is over 450° F. for firearms, in particular over 490° F. Moreover, the current specification for military lubricant (CLP) from the US Army recommends use of a lubricant having a flash point of greater than 175° F.

Any of the above-described oils may be applied to a mechanical component using the following methods. The vegetable oil or composition of vegetable oils may be applied (e.g., deposited) onto a surface of the mechanical component. This application or deposition may be performed via brushing, dropping, spraying, or any other suitable delivery method, such as applying with a paper towel or single pack moistened towelette, and spreading the applied oil evenly on the surface. The applied vegetable oil or composition of vegetable oils may be allowed to air dry. Alternatively, the applied vegetable oil or composition of vegetable oils may be heated to about 100° F. to about 400° F. to dry.

In an aspect of the present disclosure, the drying may be performed via a convection oven, furnace, or any other suitable drying equipment or method for a period of time between 10 minutes and 12 hours (hereinafter, referred to as the "treatment duration"), depending on the heat and material being treated. The treatment duration and temperature may depend on the size and material being treated. Certain metals may only withstand certain temperatures and exposure time, and, therefore, the precise time and temperature will vary. For example, a small aluminum piece, such as a charging handle that weighs 1.6 ounces, cannot withstand the same temperature intensity as a 16-ounce piece of ordnance-grade steel.

Further, the vegetable oil or composition of vegetable oils on the surface in the aluminum piece, for example, may be exposed to ultra violet (UV) light (e.g., natural sunlight or lamp) to promote oxidation of the applied composition.

In another aspect of the present disclosure, the mechanical component may be immersed in a tank containing the vegetable oil or composition of vegetable oils (the "composition") at a temperature of 100° F. to 400° F. for a period of time between 10 minutes and 24, hours depending on the material and/or the composition. Some advantage may be gained by increasing the temperature even higher than 400 F. In yet another aspect of the present disclosure, a pressure of about 1-5 ATM may be applied to the composition on the mechanical component via a pressure cooker, for example. The term "ATM" is used herein to mean the standard atmosphere, which is an international reference pressure defined as 101325 Pa and used as a unit of pressure. The time of pressure application may vary from 10 minutes or less to 24 hours or more, depending on the material and composition. Furthermore, the application method may include any combination of the above steps.

The above step of applying the composition on the surface of a mechanical component may include placing the composition in a container having a coating delivery system. For example, the container may have a pump spray, a trigger spray, or a dropper dispenser, each of which would assist a user in depositing the composition onto the mechanical component. The container may also be pressurized to allow for aerosol spraying of the composition inside. In another aspect of the present disclosure, the oil composition may be applied to the mechanical component via a wipe, wherein the wipe contains the composition. For example, the wipe may be provided in a sealed package that may be opened when a user is ready to apply the composition to the mechanical component. Once removed from the sealed package, the user can then rub the wipe against the mechanical component, thereby applying the composition onto the mechanical component. Alternatively, a sealed container may include a plurality of wipes, wherein each wipe contains the composition. The composition may also be contained in a sealed, one-time use liquid only packet.

Various example aspects have been described in accordance with the above advantages. It will be appreciated that these examples are merely illustrative of aspects of the present disclosure. Many variations and modifications will be apparent to those skilled in the art.

What is claimed is:

1. An oil for removing or preventing fouling on a mechanical component, comprising: a composition of vegetable oils having a flash point of above 490° F. and at least 75% by volume of vegetable oils having at least 80% by weight oleic acid.

2. The oil of claim 1, wherein the composition of vegetable oils has a flash point of at least 500° F.

3. The oil of claim 1, wherein the fouling comprises carbon fouling or other types of fouling on the mechanical component.

4. The oil of claim 1, wherein the mechanical component comprises a component of a firearm or a related accessory.

5. The oil of claim 4, wherein the mechanical component of the firearm is selected from the group consisting of: a trigger, a hammer, a disconnector, a trigger pin, a firing pin, a chamber, a bolt, a bolt face, a bolt carrier, a breach face, a camming pin, a piston, an operating rod, a gas tube, a barrel, a slide, a retention rail, an upper receiver, a lower receiver, a magazine follower, a suppressor mount, a compensator, a flash hider, charging handle, feed tray, and a baffle.

6. A pressurized container comprising the composition of vegetable oils of claim 1.

7. A sealed package comprising an absorbent wipe having the composition of vegetable oils of claim 1 absorbed therein.

8. A container comprising the composition of vegetable oils of claim 1, the container including a pump for releasing the composition of vegetable oils from the container.

9. The oil of claim 1, wherein the composition of vegetable oils includes at least 3:1 of a ratio of monounsaturated to polyunsaturated fats.

10. The oil of claim 1, wherein the composition of vegetable oils is configured to remain in liquid form at a temperature as low as about −10° F. and as high as about 500° F.

11. The oil of claim 1, wherein the composition of vegetable oils is configured to include a polar nature, which is not found in petroleum-based products.

12. A method of removing or preventing fouling on a mechanical component of a device, comprising: applying a composition of vegetable oils on the mechanical component of the device, wherein: the composition of vegetable oils has a flash point of 500° F. and at least 75% by volume of vegetable oils having at least 80% by weight oleic acid; and operation of the device deposits fouling on the mechanical component.

13. The method of claim 12, wherein the fouling comprises carbon fouling or other types of fouling on the mechanical component.

14. The method of claim 12, where applying comprises one of spraying, immersing, wiping, rubbing, brushing, or otherwise applying the composition of vegetable oils on the mechanical component of the device.

15. The method of claim 12, further comprising drying the applied composition of vegetable oils by heating at a temperature between about 100° F. and about 400° F.

16. The method of claim 12, further comprising exposing the applied composition of vegetable oils to ultraviolet light.

17. The method of claim 12, wherein the mechanical component is immersed in the composition of vegetable oils at a temperature of about 100° F. to about 400° F. for a period between about 10 minutes to about 24 hours.

18. The method of claim 12, wherein applying a composition of vegetable oils comprises applying a pressure of about 1 ATM to about 5 ATM.

19. The method of claim 12, wherein the mechanical component comprises a component of a firearm or a related accessory.

20. The method of claim 19, wherein the mechanical component of the firearm is selected from the group consisting of: a trigger, a hammer, a disconnector, a trigger pin, a firing pin, a chamber, a bolt, a bolt face, a bolt carrier, a breach face, a camming pin, a piston, an operating rod, a gas tube, a barrel, a slide, a retention rail, an upper receiver, a lower receiver, a magazine follower, a suppressor mount, a compensator, a flash hider, charging handle, feed tray, and a baffle.

21. The method of claim 12, wherein the mechanical component is subject to any friction or fouling.

22. The method of claim 12, further comprising drying the applied composition of vegetable oils by heating at a temperature between about 25° F. and about 125° F.

23. The method of claim 22, wherein drying the applied composition of vegetable oils by heating further comprises drying the composition of vegetable oils by heating combined with any added air movement or wind.

* * * * *